US008083314B2

(12) United States Patent
Goto

(10) Patent No.: US 8,083,314 B2
(45) Date of Patent: Dec. 27, 2011

(54) INK JET HEAD AND PRODUCTION PROCESS THEREOF

(75) Inventor: Akira Goto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 438 days.

(21) Appl. No.: 12/139,878

(22) Filed: Jun. 16, 2008

(65) Prior Publication Data

US 2008/0316272 A1 Dec. 25, 2008

(30) Foreign Application Priority Data

Jun. 21, 2007 (JP) ..... 2007-163705

(51) Int. Cl.
*B41J 2/165* (2006.01)

(52) U.S. Cl. ..... 347/29; 347/50; 347/58; 347/59; 347/87

(58) Field of Classification Search ..... 347/50, 347/57–59, 63, 87, 29, 64
See application file for complete search history.

(56) References Cited

U.S. PATENT DOCUMENTS

| | | | | |
|---|---|---|---|---|
| 5,434,607 | A * | 7/1995 | Keefe | 347/50 |
| 5,442,386 | A * | 8/1995 | Childers et al. | 347/50 |
| 5,661,510 | A * | 8/1997 | Brandon et al. | 347/87 |
| 6,071,677 | A | 6/2000 | Ishimatsu et al. | |
| 6,116,714 | A | 9/2000 | Imanaka et al. | |
| 6,188,414 | B1 * | 2/2001 | Wong et al. | 347/42 |
| 6,220,688 | B1 | 4/2001 | Ishimatsu et al. | |
| 6,312,091 | B1 * | 11/2001 | Quintana | 347/29 |
| 6,402,299 | B1 * | 6/2002 | DeMeerleer et al. | 347/50 |
| 6,554,399 | B2 * | 4/2003 | Wong et al. | 347/44 |
| 6,648,437 | B2 * | 11/2003 | Kawamura et al. | 347/8 |
| 6,799,841 | B2 | 10/2004 | Iri et al. | |
| 2007/0126798 | A1 * | 6/2007 | Touge | 347/50 |

FOREIGN PATENT DOCUMENTS

| | | |
|---|---|---|
| JP | 2005-506917 | 3/2005 |
| WO | WO 03/036763 | 5/2003 |

* cited by examiner

*Primary Examiner* — Matthew Luu
*Assistant Examiner* — Henok Legesse
(74) *Attorney, Agent, or Firm* — Fitzpatrick, Cella, Harper & Scinto

(57) ABSTRACT

An ink jet head is constituted by a recording element substrate, comprising ejection outlets for ejecting ink, to which an electrical connecting portion is provided at an outer portion of the recording element substrate; an electric wiring member having an end portion to be electrically connected to the electrical connecting portion; a supporting member comprising an outer surface, a first recess which is provided in the outer surface to accommodate the recording element substrate, and a second recess which is provided in the outer surface in a depth less than that of the first recess to accommodate the end portion of the electric wiring member; and a sealant for sealing a spacing between the second recess and the end portion of the electric wiring member.

7 Claims, 6 Drawing Sheets

(A-A)

INK JET HEAD AND PRODUCTION PROCESS THEREOF

FIELD OF THE INVENTION AND RELATED ART

The present invention relates to an ink jet head and a process for producing the ink jet head.

An ink jet recording apparatus which is a recording apparatus of so-called non-impact recording type has advantages that it is capable of effecting high-speed recording and recording on various materials to be recorded and that noise is little created during recording. For this reason, the ink jet recording apparatus is widely adopted as a printer, a word processor, a facsimile machine, a copying machine, etc.

An ink jet head provided in the ink jet recording apparatus of this type will be described. FIGS. 6A and 6B are schematic perspective views for illustrating the ink jet head. FIG. 6A is a perspective view as seen from an ejection outlet-formed surface (face surface) side, and FIG. 6B is a perspective view as seen from an opposite side to the side in FIG. 6A.

As shown in FIGS. 6A and 6B, an ink jet head 1000 includes a recording element substrate 1003 for ejecting ink droplets. This ink jet head 1000 further includes an electric wiring member 1001 for applying a driving signal and the like from a control portion (not shown) in a recording apparatus to the recording element substrate 1003 and an ink container 1010 for supplying ink to the recording element substrate 1003.

The ink is ejected from ejection outlets 1103 (FIG. 7) by using thermal energy, as ejection energy, generated by a heat generating resistor (electrothermal transducer) formed on the recording element substrate 1003.

FIG. 7 is an enlarged plan view of the face surface and a periphery thereof.

Referring to FIG. 7, ejection outlet arrays 1106, 1107 and 1108 which comprise ejection outlets 1103 corresponding to color inks of cyan, magenta and yellow, respectively, are provided to the recording element substrate 1003. Further, to the recording element substrate 1003, ink supply passages are provided in correspondence with the ejection outlet arrays (groups) 1106, 1107 and 1108. By applying an adhesive material onto a surface of the ink container 1010 at which the recording element substrate is to be connected and a surface of the ink container 1010 at which the electric wiring member 1001 is to be applied, a recording element unit is mounted in a predetermined position.

Next, a first sealant 1101 is applied in a space defined by the recording element substrate 1003, the ink container 1010 and the electric wiring member 1001. After the first sealant 1101 sufficiently extends over the space, electrical connecting portions between electrical connecting pads of the recording element substrate 1003 and inner leads 1002 of the electric wiring member 1001 are sealed up by a second sealant 1004. Thereafter, each of the color inks is injected into a corresponding portion of the ink container 1010 in a predetermined amount and then a cap member 1011 is connected to the ink container 1010.

The thus prepared ink jet head 1000 is covered with a cap mechanism provided in the recording apparatus in order to prevent the ejection outlets 1103 from drying in a rest state in which a recording signal is not inputted when the ink jet head 1000 is mounted in the recording apparatus. Further, the ink jet head 1000 is also covered with the cap mechanism so as to retain its hermeticality in the cases where a contaminant deposited on an ejection surface at which the ejection outlets are arranged is removed and where the ink jet head 1000 placed in an ejection failure state caused due to bubbles generated in the passages or the ejection outlets 1103 is restored to a normal state. In a state in which the ink jet head 1000 is sealed up with a cap of the cap mechanism, ink is sucked from the ejection outlets by placing the inside of the cap in a negative-pressure state.

A rectangular frame-like area shown in FIG. 7 represents a cap contact portion 1105 of the ink jet head 1000. This cap contact portion 1105 is located at a surface of a single member consisting of the electric wiring member 1001, thus being kept at a certain flatness level. For this reason, there is substantially no leakage of air from the cap contact portion 1105 in a contact state with the cap.

In recent years, downsizing of the ink jet head is required. For this purpose, a sheet surface of the electric wiring member 1001 located at a periphery of the recording element substrate 1003 as shown in FIG. 7 is required to be reduced in area.

In order to obviate an increase in size of an electric wiring member, International Publication No. WO 03/036763 (corr. to Japanese Laid-Open Patent Application (TOKUHYO) 2005-506917) discloses a constitution in which a recording element substrate is provided with electrical connecting pads only at one end portion thereof to ensure downsizing of the electric wiring member. In this constitution, however, it is possible to achieve the downsizing of the electric wiring member but an additional part called a capping shroud is provided (for covering the electric wiring member) in order to keep a flatness of a cap contact portion. For this reason, the additional part is required, so that reduction in production cost cannot be ensured.

SUMMARY OF THE INVENTION

A principal object of the present invention is to provide an ink jet head capable of reducing a production cost and ensuring reliability during hermetical sealing of ejection outlet groups.

Another object of the present invention is to provide a process for producing the ink jet head.

According to an aspect of the present invention, there is provided an ink jet head comprising:

a recording element substrate, comprising ejection outlets for ejecting ink, to which an electrical connecting portion is provided at an outer portion of the recording element substrate;

an electric wiring member having an end portion to be electrically connected to the electrical connecting portion;

a supporting member comprising an outer surface, a first recess which is provided in the outer surface to accommodate the recording element substrate, and a second recess which is provided in the outer surface in a depth less than that of the first recess to accommodate the end portion of the electric wiring member; and a sealant for sealing a spacing between the second recess and the end portion of the electric wiring member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings.

Figure 1:
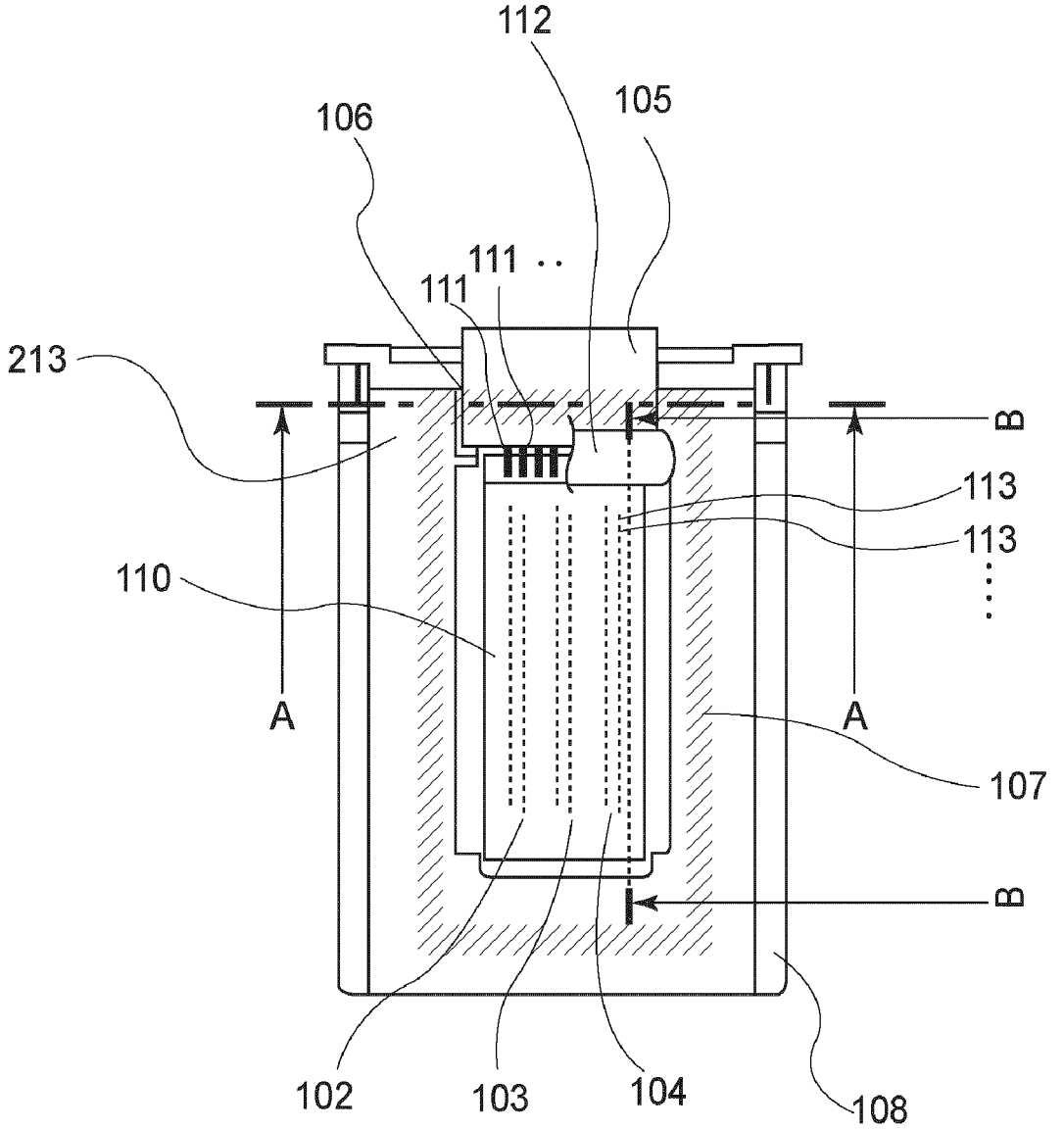
FIG. 1 is a schematic plan view showing an ink jet head according to an embodiment of the present invention.

As shown in FIG. 1, an ink jet head 101 includes a recording element substrate 110 to which ejection outlets 113 for ejecting ink and an energy generating element (electrothermal transducer or heat generating resistor) are provided. The ink jet head 101 further includes an ink container 108 for supplying the ink to the recording element substrate 110 and an electric wiring member (substrate) 105 for transferring an electric signal with respect to a control portion (not shown) in an ink jet recording apparatus.

To the recording element substrate 110, ejection outlet arrays 102, 103 and 104, each comprising a plurality of ejection outlets 113, corresponding to color inks of cyan, magenta and yellow, respectively, are provided. These ejection outlet arrays 102, 103 and 104 are provided at a surface (face surface) at which the ejection outlets of the recording element substrate 110 are formed with respect to a longitudinal direction of the recording element substrate 110. The recording element substrate 110 further includes ink supply passages (not shown) corresponding to the ejection outlet arrays 102, 103 and 104, respectively. At an outer portion of the recording element substrate 110, on one longitudinal end side, an electrical connecting pad (not shown) as an electrical connecting portion to which the electric wiring member 105 is electrically connected is provided.

At on end portion of the electric wiring member 105, inner leads 111 as inner wiring are exposed. These inner leads 111 are bonded and electrically connected to the electrical connecting pad provided to only one of four edges of the outer portion of the recording element substrate 110.

The electrical connecting pad to which the inner leads 111 of the electric wiring member 105 are connected is covered and sealed up with a sealant 112 as a sealing member.

To the ink container 108, an ink containing portion (not shown) at which a porous resin member for absorbing and retaining ink to be supplied to the recording element substrate 110 is provided and communicates with the recording element substrate 110 through ink passages.

The ink container 108 also functions as a supporting member for supporting the recording element substrate 110 and the electric wiring member 105.

To the ink container 108, an element fixing portion 209 at which the recording element substrate 110 is accommodated and fixed and a wiring fixing portion 210 at which one end portion of the electric wiring member 105 where the inner leads 111 are exposed are provided.

The element fixing portion 209 includes a first flat surface portion 211 on which the recording element substrate 110 is fixed. The wiring fixing portion 210 includes a second flat surface portion 212 at which the electric wiring member 105 is fixed through an adhesive layer 206. At an outer surface of the ink container 108, a third flat surface portion 213 is formed. With respect to a thickness direction of the recording element substrate 110, the first flat surface portion 211, the second flat surface portion 212 and the third flat surface portion 213 are disposed in this order toward the outer surface of the ink container 108.

The second flat surface portion 212 is constituted to have a width, in a direction perpendicular to an arrangement direction of the ejection outlet arrays 102, 103 and 104, larger than a width of one end portion of the electric wiring member 105 and constituted to have a depth from the third flat surface portion 213 larger than a thickness of the electric wiring member 105. In a spacing between a side end surface of the electric wiring member 105 disposed at the wiring fixing portion 210 with respect to a width direction of the electric wiring member 105 and a side wall of the wiring fixing portion 210, the sealant 112 is filled.

A process for producing the ink jet head of this embodiment is as follows.

A recording element unit constituted by electrically connecting the electrical connecting pad of the recording element substrate 110 and the inner leads of the electric wiring member 105 is prepared. Further, the ink container 108 constituted to have the width slightly larger than the width of the electric wiring member 105 and constituted to have the depth, from the third flat surface portion 213 as the outer surface of the ink container 108, slightly larger than the thickness of the electric wiring member 105 is prepared.

An adhesive material consisting of a photocurable/thermosetting resin material is applied onto the first flat surface portion 211 at which the recording element substrate 110 is fixed and the second flat surface portion 212 at which the electric wiring member 105 is fixed, followed by irradiation with ultraviolet (UV) rays or light to be activated.

Then, in a state in which the recording element unit is held by holding fingers (not shown) as a holding means, the recording element unit is located in a predetermined position of the ink container 108 and applied onto the ink container 108, and the recording element substrate 110 is partly heated to be temporarily fixed. In this temporarily fixed state, the electric wiring member 105 is pressed against the ink container 108 by using a flat surface of a thermocompression bonding tool (thermocompression horn) with the third flat surface portion 213 of the ink container 108 as a stopper. As a result, the third flat surface portion 213 of the ink container 108 and the surface of the electric wiring member 105 fixed at the wiring fixing portion 210 can be formed so as to be located in the substantially same plane. Then, the electric wiring member 105 is completely bonded by the adhesive material consisting of the photocurable/thermosetting resin material in the wiring fixing portion 210.

Next, the electrical connecting pad is coated by applying the sealant 112 onto the electrical connecting pad with a dispenser so that the electrical connecting pad to which one end portion of the electric wiring member 105 is connected is not exposed. In the case where a sealant has a relatively low flowability, the sealant may also be applied before the recording element unit is fixed to the ink container 108. On each of both sides of the electric wiring member 105 with respect to a width direction of the electric wiring member 105, a spacing 106 having a dimension (width) a (FIG. 2) is created between a side end surface of the electric wiring member 105 and a side wall of the wiring fixing portion 210 at which the electric wiring member 105 is fixed. The sealant 112 enters this spacing 106 by a capillary phenomenon to fill the spacing 106. Finally, the adhesive material consisting of the photocurable/thermosetting resin material applied onto the second flat surface portion 212 on which the electric wiring member 105 is fixed and the sealant 112 are subjected to heat curing so as to be completely cured. After the heat curing, the porous resin material for holding the ink and generating a negative pressure is inserted into the ink containing portion of the ink container and the ink is injected into the ink containing portion in a predetermined amount. Then, the cap member is bonded to an opening of the ink containing portion to complete preparation of the ink jet head.

After the head curing is performed, the sealant 112 filling the spacing 106 heat-contracts by about several % in height. However, the thickness of the electric wiring member 105 used in this embodiment is about 0.1 mm, so that the height of the sealant 112 was merely lowered from the third flat surface portion 213 and the surface of the electric wiring member 105 which constitute the outer surface of the ink container 108 by about several μm. Therefore, in a state in which the recording element substrate 105 is hermetically covered with the cap, leakage of air at the cap contact portion 107 was not substantially caused to occur.

As described above, according to this embodiment, to the ink container 108, the wiring fixing portion 210 having the width larger than that of the electric wiring member 105 and the depth larger than the thickness of the electric wiring member 105 is provided. In this embodiment, by this constitution, it is possible to ensure good flatness with respect to the surface of the electric wiring member 105 fixed at the wiring fixing portion 210 and the third flat surface portion 213 constituting the outer surface of the ink container 108.

Further, according to this embodiment, the spacing between the side end surface of the electric wiring member 105 and the side wall of the wiring fixing portion 210 is naturally filled with the sealant 112 for coating the electrical connecting pad by the capillary phenomenon. For this reason, in this embodiment, it is not necessary to separately provide an additional part, i.e., it is possible to reduce the production cost and effectively ensure the flatness of the cap contact portion 107. Accordingly, according to this embodiment, it is possible to ensure reliability during hermetical sealing of the ejection outlet arrays (groups) 102, 103 and 104 with the cap by a refreshing operation or the like of the ink jet head.

Further, according to this embodiment, the electrical connecting pad is provided on one end side of the recording element substrate 110 with respect to a longitudinal direction of the recording element substrate 110, so that it is not necessary to provide the electric wiring member 105 with an opening for exposing the face surface of the recording element substrate 110 to the outside. For this reason, in this embodiment, even in the case where a longitudinal dimension of the recording element substrate 110 is increased, it is possible to transfer an electric signal by using a relatively small electric wiring member 105 irrespective of the size of the recording element substrate 110.

First Embodiment

Figure 2:
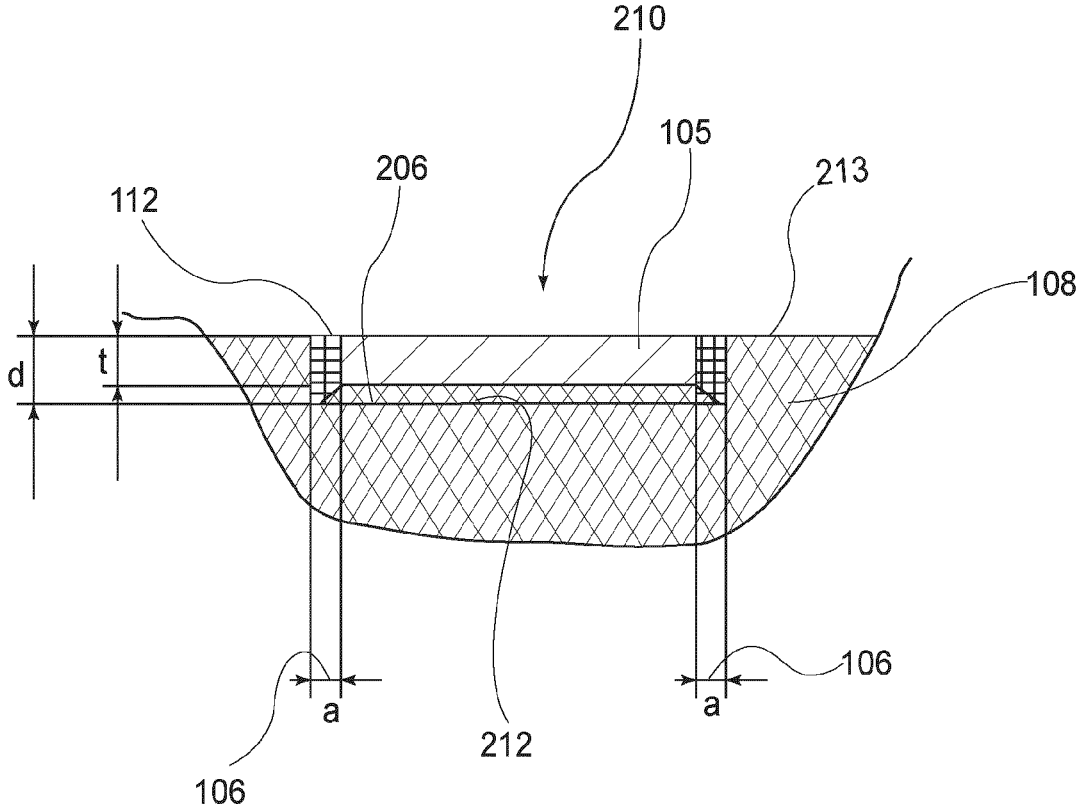
FIG. 2 is a schematic sectional view, taken along A-A line in FIG. 1, showing an ink jet head in Embodiment 1.
Figure 3:
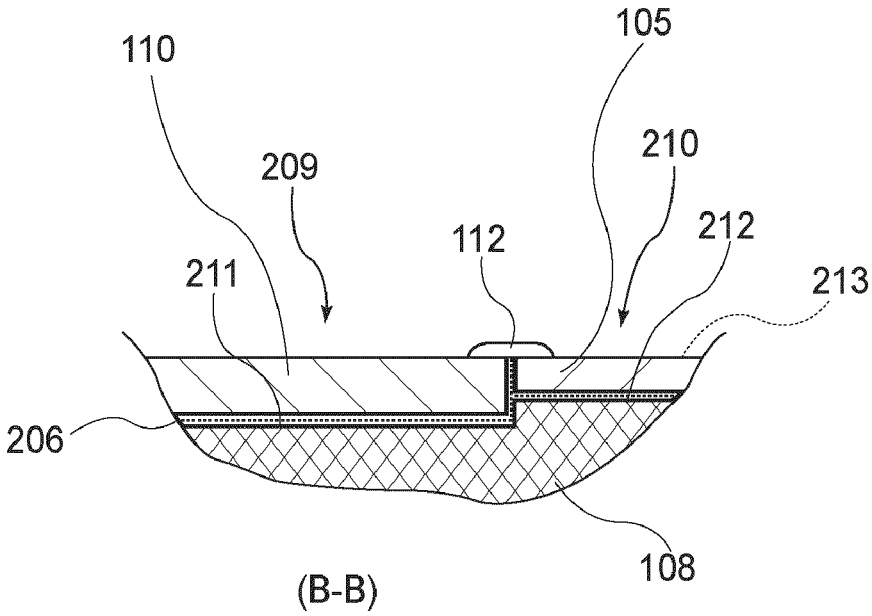
FIG. 3 is a schematic sectional view, taken along B-B line in FIG. 1, showing the ink jet head in Embodiment 1.

FIG. 2 is a sectional view, taken along A-A line in FIG. 1, for illustrating First Embodiment. FIG. 3 is a sectional view, taken along B-B line in FIG. 1, for illustrating this embodiment. In this embodiment, an electric wiring member 105 having a thickness t (FIG. 4) of 0.10 mm was used. A wiring fixing portion 210 at which the electric wiring member 105 was to be formed was formed so that a second flat surface portion 212 was formed in a width layer than a width of the electric wiring member 105 by about 0.2 mm and a third flat surface portion 213 was formed in a depth d (FIG. 4) of about 0.20 mm larger than the thickness of the electric wiring member 105. An ink container 108 was formed by ejection molding with a modified PPE resin material which is a thermoplastic resin material and has a heat distortion temperature of about 120° C. The ink container 108 is formed of the thermoplastic resin material having the heat distortion temperature higher than a temperature at which an adhesive layer 206 described later is cured, so that deformation of the ink container 108 is not caused to occur when an adhesive material is cured.

The adhesive layer 206 of the electric wiring member 105 was formed by applying an adhesive material consisting of a photocurable/thermosetting resin material through transfer with a rubber plate. A thickness of the adhesive material consisting of the photocurable/thermosetting resin material during the application was 0.15 mm. Then, the adhesive material is irradiated with UV light to be activated and a recording element unit is applied to the ink container 108 in a predetermined position. Thereafter, the recording element substrate 110 is partly heated to be temporarily fixed. At the time of this temporary fixation, a height of the surface of the electric wiring member 105 is somewhat higher than that of the third flat surface portion 213 of the ink container 108. In such a temporarily fixed state, the electric wiring member 105 is pressed for several seconds against the ink container 108 by using a flatness-ensured thermocompression bonding tool, heated to a predetermined temperature so as to reach 80° C. in the adhesive layer 206. As a result, the third flat surface portion 213 of the ink container 108 and the surface of the electric wiring member 105 fixed at the wiring fixing portion 210 can be formed so as to be located in the substantially same plane which can be regarded substantially as the same surface. At the same time, the wiring fixing portion 210 and the electric wiring member 105 were completely bonded by the adhesive material consisting of the photocurable/thermosetting resin material.

Next, the sealant 112 was applied onto the electrical connecting pad with a dispenser so that the electrical connecting pad is not exposed. In the case where a sealant having a relatively low flowability, the sealant may also be applied before the recording element unit is applied to the ink container 108.

The sealant 112 entered a spacing 106 between a side end surface of the electric wiring member 105 and a side wall of the wiring fixing portion 210 by a capillary phenomenon to fill the spacing 106. Finally, the adhesive material consisting of the photocurable/thermosetting resin material applied onto the second flat surface portion 212 on which the electric wiring member 105 is fixed and the sealant 112 are subjected to heat curing for 1 hour at 100° C. so as to be completely cured.

At the cap contact portion 107 of the thus prepared ink jet head 101, the flatness was effectively ensured as described above.

Second Embodiment

Figure 4:
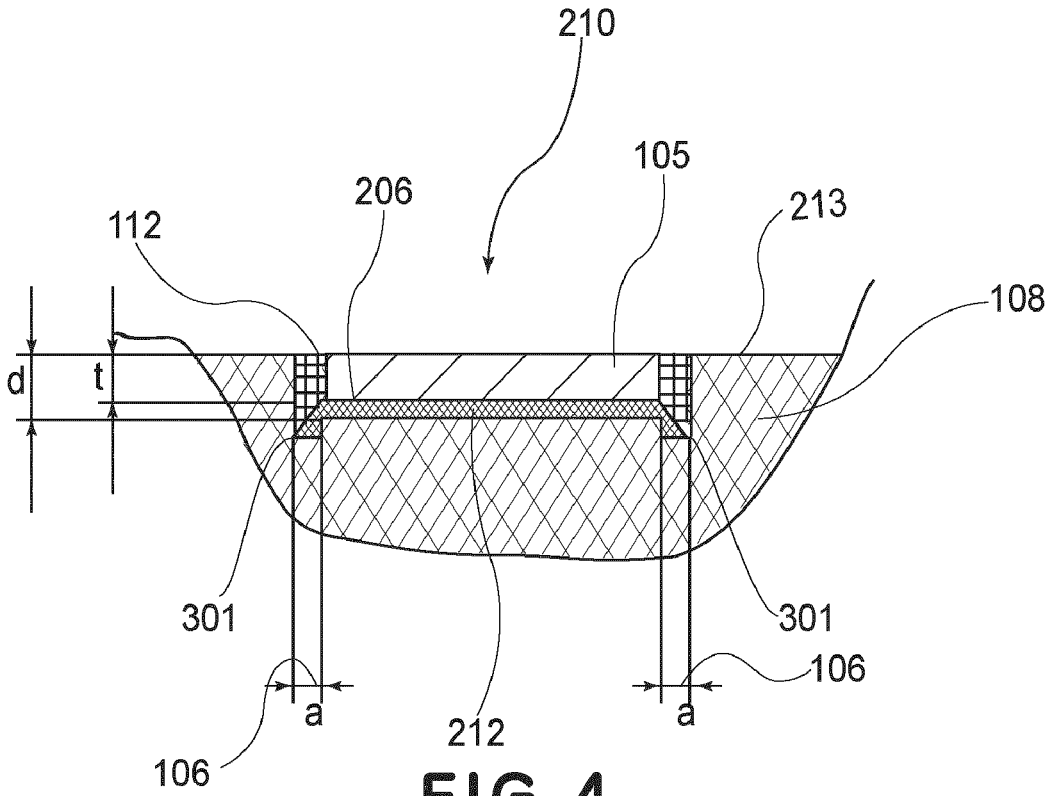
FIG. 4 is a schematic sectional view showing an ink jet head in Embodiment 2.

FIG. 4 is a sectional view for illustrating Second Embodiment. In this embodiment, as shown in FIG. 4, to a second flat surface portion 212, linear grooves 301 in which an adhesive layer (adhesive material) 206 is to be accommodated and filled by an overflow from a wiring fixing portion 210 when a flat surface of a thermocompression bonding tool is struck against a third flat surface portion 213 to press an electric wiring member 105 are provided. Each of these grooves 310 is provided in a position corresponding to a spacing 106 between a side end surface of the electric wiring member 105 disposed at the wiring fixing portion 210 and a side wall of the wiring fixing portion 210.

In this embodiment, by providing the grooves 301 at the second flat surface portion 212, it is possible to prevent the adhesive material from overflowing from the wiring fixing portion 210 during production of an ink jet recording head. For this reason, according to this embodiment, it is possible to eliminate the need for a maintenance operation for removing the adhesive material bonded to the thermocompression bonding tool, so that the production cost can be further lowered.

Third Embodiment

Figure 5:
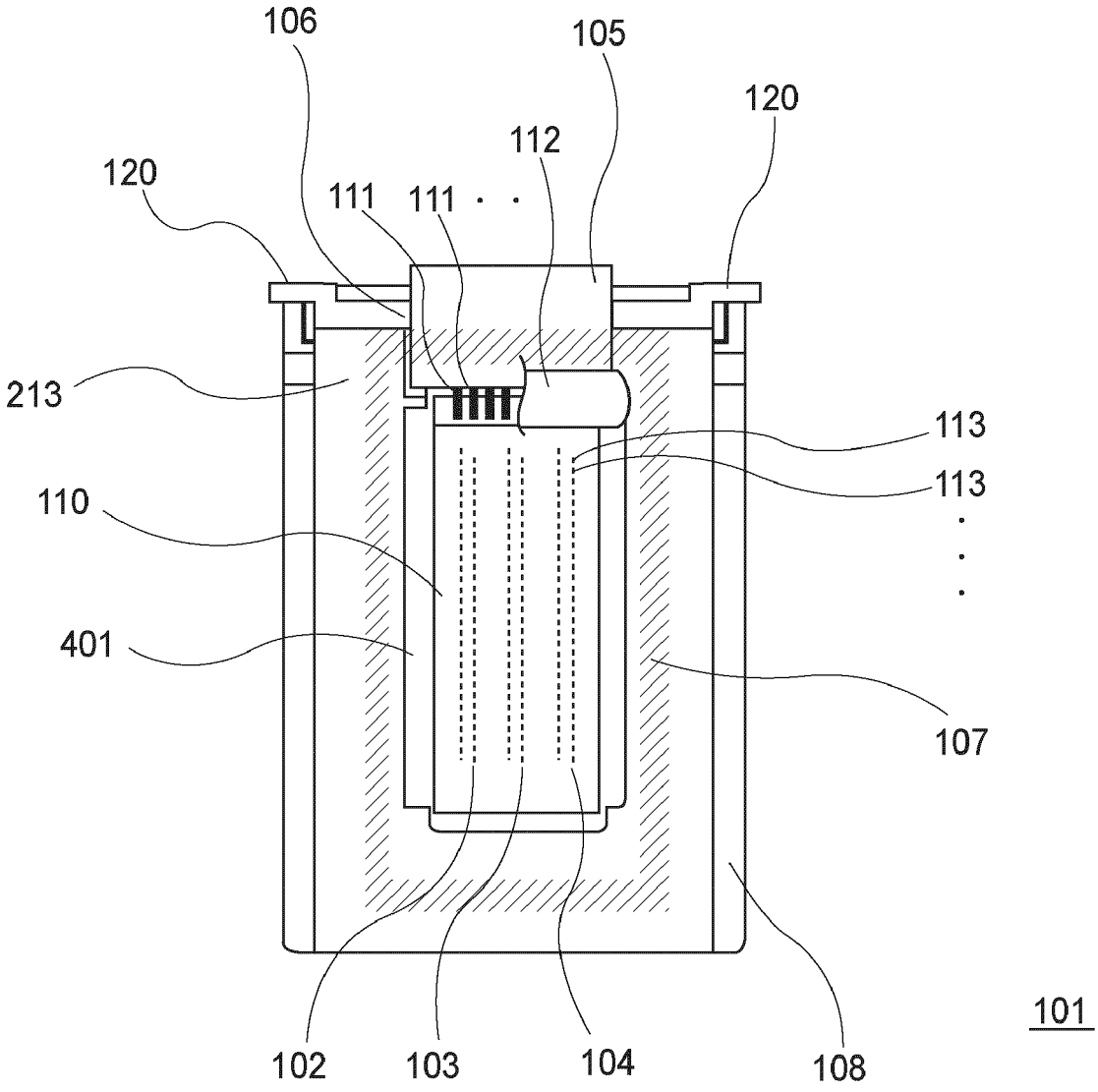
FIG. 5 is a schematic sectional view showing an ink jet head in Embodiment 3.
Figure 6B:
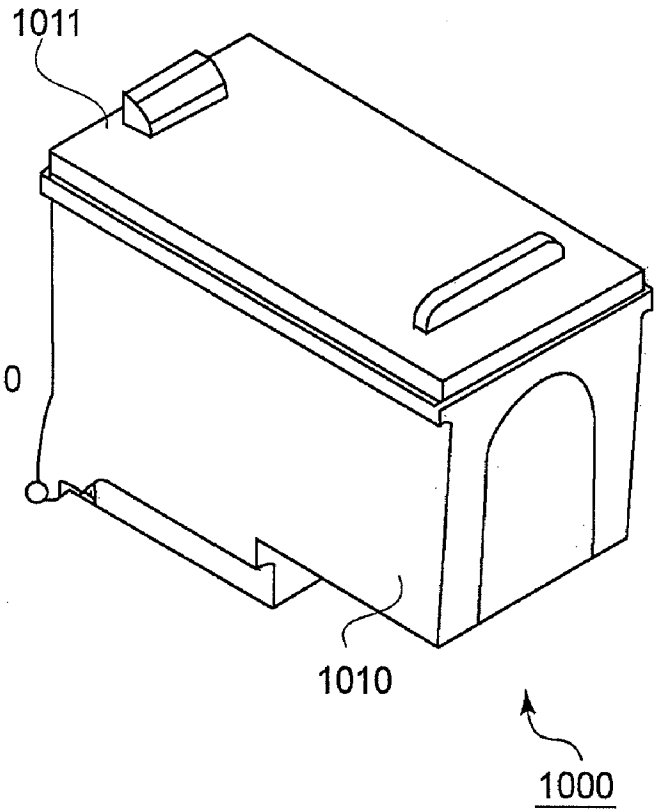
FIG.6B PRIOR ART
FIGS. 6A and 6B are schematic views showing a conventional ink jet head.
Figure 6A:
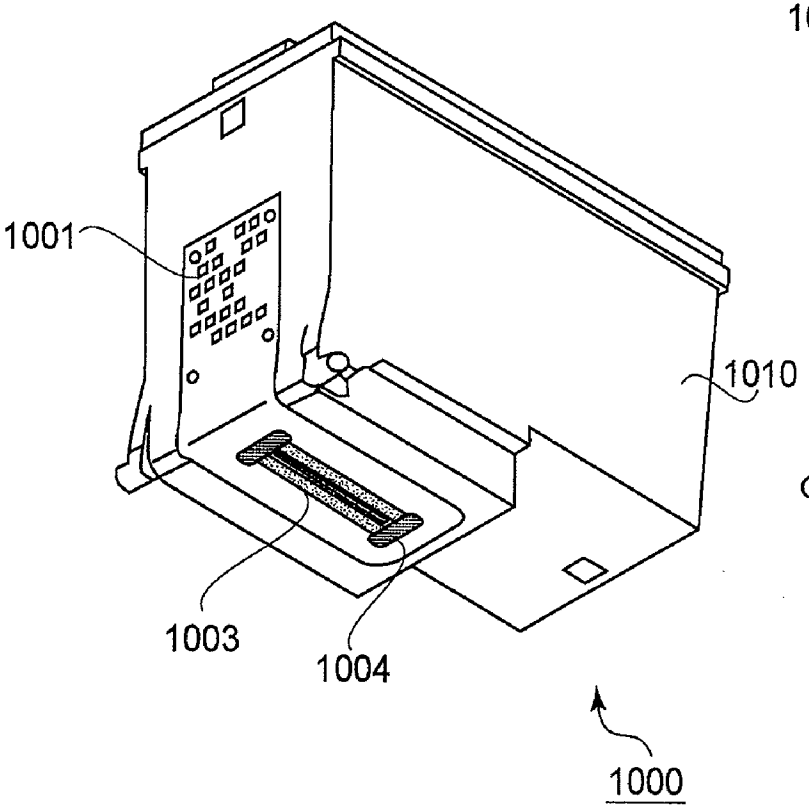
FIG.6A PRIOR ART
Figure 7:
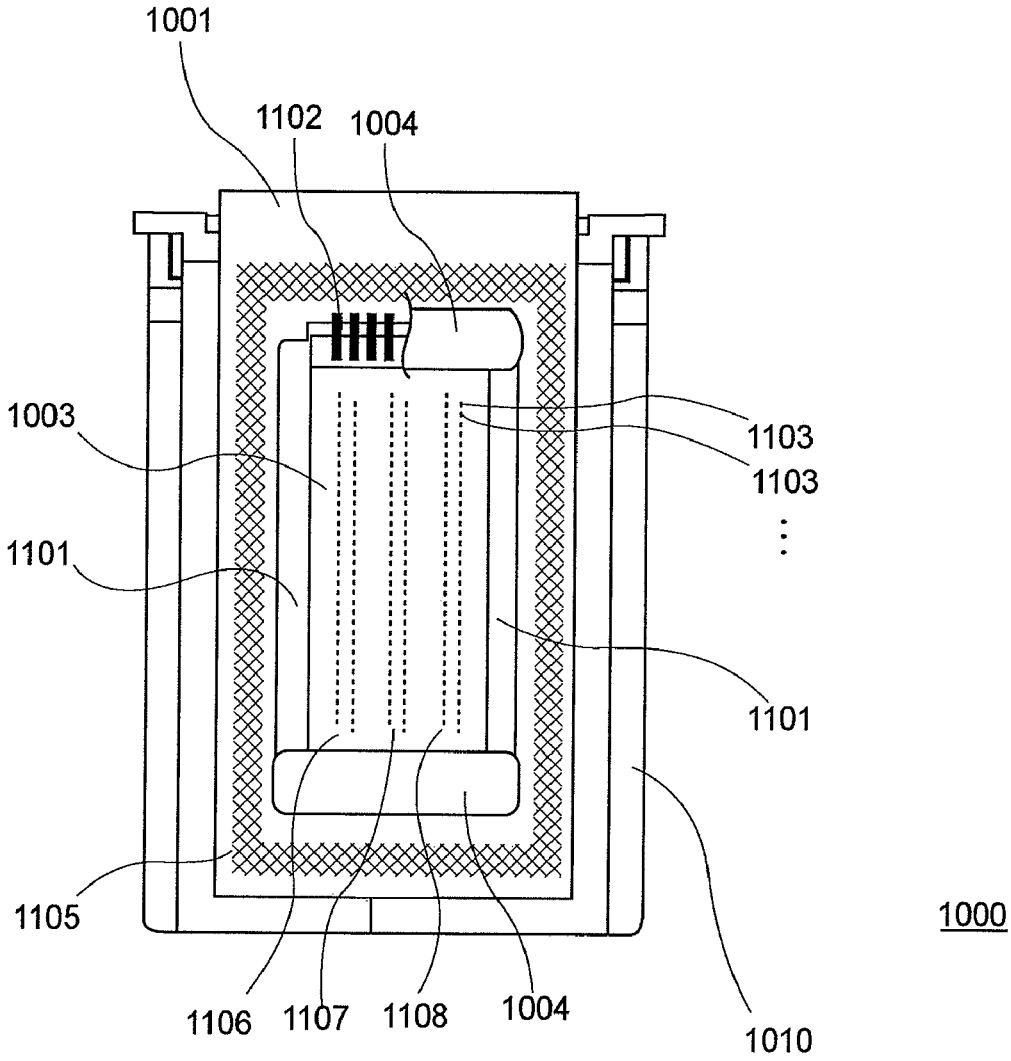
FIG.7 PRIOR ART
FIG. 7 is a schematic plan view showing a conventional ink jet head as seen from a face surface side.

FIG. 5 is a plan view for illustrating Third Embodiment. As shown in FIG. 5, in spacings each between a side end portion of a recording element substrate 110 with respect to a width direction perpendicular to a longitudinal direction of the recording element substrate 110 and a side wall of an element fixing portion 209 at which the recording element substrate 110 is to be fixed, a second sealant 401 is filled to bury the element fixing portion 209. In this embodiment, as a first sealant (first sealing member) 112 for covering and sealing up an electrical connecting pad, a relative high viscosity material may preferably be used and as a second sealant (second sealing member) 401, a relatively low viscosity material may preferably be used.

A process for producing the ink jet head of this embodiment is as follows.

A recording element unit constituted by electrically connecting the electrical connecting pad of the recording element substrate 110 and the inner leads of the electric wiring member 105 is prepared. Further, the ink container 108 constituted to have the width slightly larger than the width of the electric wiring member 105 and constituted to have the depth, from the third flat surface portion 213 as the outer surface of the ink container 108, slightly larger than the thickness of the electric wiring member 105 is prepared.

An adhesive material consisting of a photocurable/thermosetting resin material is applied onto the first flat surface portion 211 at which the recording element substrate 110 is fixed and the second flat surface portion 212 at which the electric wiring member 105 is fixed, followed by irradiation with UV light to be activated.

Then, in a state in which the recording element unit is held by holding fingers (not shown), the recording element unit is located in a predetermined position of the ink container 108, and the recording element substrate 110 is partly heated to be temporarily fixed. In this temporarily fixed state, the electric wiring member 105 was pressed against the ink container 108 by using a flat surface of a heated thermocompression bonding tool with the third flat surface portion 213 of the ink container 108 as a stopper. As a result, the third flat surface portion 213 of the ink container 108 and the surface of the electric wiring member 105 fixed at the wiring fixing portion 210 were able to be formed so as to be located in the substantially same plane. At the same time, the ink container 108 and the electric wiring member 105 were completely bonded by the adhesive material consisting of the photocurable/thermosetting resin material.

Next, the second sealant 401 was applied over the outer surface of the recording element substrate 100 with a dispenser and then the sealant 112 was applied similarly with a dispenser so that the electrical connecting pad was not exposed. The second sealant 401 entered spacings 106 each between a lateral (widthwise) side end surface of the electric wiring member 105 and a side wall of the wiring fixing portion 210 by a capillary phenomenon to fill the spacings 106. Finally, the adhesive material consisting of the photocurable/thermosetting resin material applied onto the second flat surface portion 212 on which the electric wiring member 105 is fixed and the first and second sealants 112 and 401 are subjected to heat curing for 1 hour at 100° C. so as to be completely cured. After the heat curing, the porous resin material for holding the ink and generating a negative pressure is inserted into the ink containing portion of the ink container and the ink is injected into the ink containing portion in a predetermined amount. Then, the cap member is bonded to an opening of the ink containing portion to complete preparation of an ink jet recording head.

At the cap contact portion 107 of the thus prepared ink jet head 101, flatness was effectively retained as described above.

Each of the ink jet heads produced through the production processes described in First to Third Embodiments was mounted in a recording apparatus and subjected to various reliability tests. As a result, no failure in a cap contact state was caused to occur, so that it was possible to substantiate effectiveness of the ink jet heads 101. By this, it was possible to ensure good flatness with respect to the surface of the electric wiring member fixed at the wiring fixing portion and the third flat surface portion. Thus, reliability during hermetic sealing of the ejection outlet arrays (groups) was able to be ensured while the production cost was reduced.

While the invention has been described with reference to the structures disclosed herein, it is not confined to the details set forth and this application is intended to cover all such modifications or changes as may come within the purpose of the improvements or the scope of the following claims.

This application claims priority from Japanese Patent Application No. 163705/2007 filed Jun. 21, 2007, which is hereby incorporated by reference herein.

What is claimed is:

1. An ink jet head for being mounted on a recording apparatus, comprising:

a recording element substrate comprising ejection outlets for ejecting ink and an electrical connecting portion being provided at an outer portion of said recording element substrate;

an electric wiring member comprising a plurality of wiring lines therein and comprising inner leads, wherein an end portion of said electric wiring member is electrically connected to an end portion of said recording element substrate by the inner leads of said electric wiring member;

a supporting member comprising an outer surface, a first recess which is provided in the outer surface to accommodate said recording element substrate, and a second recess which is provided in the outer surface with a depth less than that of the first recess to accommodate the end portion of said electric wiring member; and a sealant for sealing a spacing between the second recess and the end portion of said electric wiring member, at least a portion of the sealant being provided in the second recess, wherein said electric wiring member, the portion of said sealant and the outer surface of said supporting member define a region to which a cap member, provided to the recording apparatus, for covering the ejection outlets is to be contacted.

2. A head according to claim 1, wherein the outer surface of said supporting member and an upper surface of the end portion of said electric wiring member are located in the substantially same plane.

3. An ink jet head for being mounted on a recording apparatus, comprising:

a recording element substrate comprising an ejection outlet group for ejecting ink and an ink supply port for supplying the ink to the ejection outlet group;

an electric wiring member comprising a plurality of wiring lines therein and comprising inner leads, wherein an end portion of said electric wiring member is electrically connected to an end portion of said recording element substrate by the inner leads of said electric wiring member;

a supporting member comprising an element fixing portion for accommodating and fixing said recording element substrate and a wiring fixing portion for fixing the end portion of said electric wiring member; and a sealing member for covering the electrical connecting portion to which said electric wiring member is electrically connected, wherein the element fixing portion has a first flat surface portion at which said recording element substrate is to be fixed, the wiring fixing portion has a second flat surface portion at which said electric wiring member is to be fixed through an adhesive layer, and to said supporting member, a third flat surface portion is provided at an outer surface of said supporting member, at least a portion of said sealing member being provided on the second flat surface portion, wherein the first flat surface portion, the second flat surface portion, and the third flat surface portion are disposed in this order toward the outer surface of said supporting member with respect to a thickness direction of said recording element substrate, wherein the second flat surface portion has a width greater than a width of the end portion of said electric wiring member and has a depth, from the third flat surface portion, greater than a thickness of said electric wiring member, wherein said sealing member is filled in a spacing between a side end surface of said electric wiring member disposed at the wiring fixing portion with respect to a width direction of said electric wiring member and a side wall of the wiring fixing portion, and wherein said electric wiring member, said sealing member and the third flat surface portion define a region to which a cap member, provided to the recording apparatus, for covering the ejection outlets is to be contacted.

4. A head according to claim 3, wherein the electric connecting portion is provided on one end side of said recording element substrate with respect to a longitudinal direction of said recording element substrate.

5. A head according to claim 3, wherein said electric wiring member comprises an inner wiring portion exposed at the end portion, and wherein the inner wiring portion is bonded to the electrical connecting portion.

6. A head according to claim 3, wherein a surface of the third flat surface portion and a surface of said electric wiring member are located in the substantially same plane.

7. A recording apparatus comprising:

a cap member for covering ejection outlets of an ink jet recording head, wherein the ink jet recording head includes:

a recording element substrate, comprising the ejection outlets for ejecting ink, and including an electrical connecting portion provided at an outer portion of said recording element substrate;

an electric wiring member comprising a plurality of wiring lines therein and comprising inner leads, wherein an end portion of said electric wiring member is electrically connected to an end portion of said recording element substrate by the inner leads of said electric wiring member;

a supporting member comprising an outer surface, a first recess which is provided in the outer surface to accommodate said recording element substrate, and a second recess which is provided in the outer surface with a depth less than that of the first recess to accommodate the end portion of said electric wiring member; and a sealant for sealing a spacing between the second recess and the end portion of said electric wiring member, at least a portion of said sealant being provided in the second recess, wherein said cap member is to be contacted to said electric wiring member, said sealant and the outer surface to cover the ejection outlets.

* * * * *